US010787025B2

(12) United States Patent
Kogure

(10) Patent No.: US 10,787,025 B2
(45) Date of Patent: Sep. 29, 2020

(54) THERMOCHROMIC WRITING TOOL

(71) Applicant: Kabushiki Kaisha Pilot Corporation, Tokyo (JP)

(72) Inventor: Masahiro Kogure, Takasaki (JP)

(73) Assignee: Kabushiki Kaisha Pilot Corporation, Tokyo (JP)

( * ) Notice: Subject to any disclaimer, the term of this patent is extended or adjusted under 35 U.S.C. 154(b) by 0 days.

(21) Appl. No.: 16/471,840

(22) PCT Filed: Dec. 15, 2017

(86) PCT No.: PCT/JP2017/045103
§ 371 (c)(1),
(2) Date: Jun. 20, 2019

(87) PCT Pub. No.: WO2018/123655
PCT Pub. Date: Jul. 5, 2018

(65) Prior Publication Data

US 2020/0094610 A1 Mar. 26, 2020

(30) Foreign Application Priority Data

Dec. 27, 2016 (JP) ..... 2016-253411

(51) Int. Cl.
*B43K 24/08* (2006.01)
*B43K 5/16* (2006.01)
(Continued)

(52) U.S. Cl.
CPC ..... *B43K 24/08* (2013.01); *B43K 5/16* (2013.01); *B43K 7/12* (2013.01); *B43K 29/02* (2013.01)

(58) Field of Classification Search
CPC ..... B43K 24/08; B43K 24/00; B43K 24/084; B43K 24/086; B43K 24/088; B43K 24/16;
(Continued)

(56) References Cited

U.S. PATENT DOCUMENTS

2010/0098476 A1* 4/2010 Imamura ..... B43K 24/08 401/1
2012/0308290 A1* 12/2012 Ito ..... B43K 7/02 401/104

FOREIGN PATENT DOCUMENTS

EP 0321581 A1 6/1989
JP 55130887 U 9/1980
(Continued)

OTHER PUBLICATIONS

Kumazawa, "Prediction of Friction Coefficient of Tire Rubber by Multiscale Model", Master's Thesis, 2012, 103 pages.
(Continued)

*Primary Examiner* — David J Walczak
(74) *Attorney, Agent, or Firm* — The Webb Law Firm

(57) ABSTRACT

A thermochromic writing tool which includes a writing element including a reservoir in which thermochromic ink is retained, and a writing point portion which is disposed on a front end portion of the reservoir and from which the thermochromic ink is dischargeable; a barrel which is made of a resin and in which the writing element is accommodated so as to be movable in a longitudinal direction; a protruding and retracting mechanism including a push element made of a resin and disposed on a rear end portion of the barrel so as to be tiltable in a radial direction relative to an axis of the barrel; and a rub portion disposed on a rear end portion of the push element 5.

3 Claims, 6 Drawing Sheets

(51) Int. Cl.
*B43K 7/12* (2006.01)
*B43K 29/02* (2006.01)

(58) Field of Classification Search
CPC . B43K 5/16; B43K 5/005; B43K 7/02; B43K 7/12; B43K 8/24; B43K 29/02; B43K 29/00; B43K 27/08; B43K 27/12
See application file for complete search history.

(56) References Cited

FOREIGN PATENT DOCUMENTS

| | | | |
|---|---|---|---|
| JP | 717585 | U | 3/1995 |
| JP | 200990566 | A | 4/2009 |
| JP | 2012223949 | A | 11/2012 |
| JP | 201520282 | A | 2/2015 |
| JP | 2015208952 | A | 11/2015 |
| JP | 201687864 | A | 5/2016 |
| JP | 201713342 | A | 1/2017 |

OTHER PUBLICATIONS

Watanabe, "Friction and Wear of Polymers Against Metals" The Japan Institute of Metals and Materials Journal, 1980, 7 pages, vol. 19, No. 1.

* cited by examiner

THERMOCHROMIC WRITING TOOL

CROSS-REFERENCE TO RELATED APPLICATIONS

This application is the United States national phase of International Application No. PCT/JP2017/045103 filed Dec. 15, 2017, and claims priority to Japanese Patent Application No. 2016-253411 filed Dec. 27, 2016, the disclosures of which are hereby incorporated by reference in their entirety.

TECHNICAL FIELD

The present invention relates to a thermochromic writing tool in which a push element has on its rear end portion a rub portion capable of thermally discoloring a writing with thermochromic ink by frictional heat generated when the writing with the thermochromic ink is rubbed with the rub portion.

BACKGROUND ART

A thermochromic writing tool provided with a rub portion has been disclosed (refer to, for example, Patent Literature 1). Such a rub portion is disposed on one end of a barrel that constitutes a writing tool, and is made of a soft resin capable of thermally discoloring a writing with thermochromic ink by frictional heat generated when the writing with the thermochromic ink is rubbed with the rub portion.

CITATION LIST

Patent Literature

Patent Literature 1: JP 2009-90566 A

SUMMARY OF INVENTION

Technical Problem

As disclosed in Patent Literature 1, a push element on a rear end of a barrel is pressed frontward. In a case where a rub portion is disposed on an operation portion, when a rubbing operation is performed using the rub portion, a pressing force is applied toward a sheet of paper, so that the push element moves frontward, which may hinder a stable rubbing operation. Particularly, in a case of employing a protruding and retracting mechanism configured to press a push element frontward in both of a writing point portion protruding operation and a writing point portion retracting operation (a writing tool of a so-called a double push type), when a rub portion is disposed on the push element, the push element wobbles in a longitudinal direction, which may also hinder a stable rubbing operation.

Hence, the present invention has been made to solve the problem described above, and an object of the present invention is to provide a thermochromic writing tool capable of a stable rubbing operation with a simple structure, using a rub portion on a rear end of a push element.

Solutions to Problem

A first aspect of the present invention provides a thermochromic writing tool including:

a writing element including a reservoir in which thermochromic ink is retained, and a writing point portion which is disposed on a front end portion of the reservoir and from which the thermochromic ink is dischargeable;

a barrel which is made of a resin and in which the writing element is accommodated so as to be movable in a longitudinal direction;

a protruding and retracting mechanism including a push element made of a resin and disposed on a rear end portion of the barrel so as to be tiltable in a radial direction relative to an axis of the barrel, the push element having a contour smaller than an inner diameter of the barrel, the protruding and retracting mechanism being configured to cause the writing point portion to protrude from the barrel through a front-end opening of the barrel when the push element is pressed toward the front-end opening of the barrel, the protruding and retracting mechanism being configured to cancel a state in which the writing point portion protrudes when the push element is pressed frontward again, and to cause the writing point portion to retract into the barrel through the front-end opening of the barrel; and a rub portion disposed on a rear end portion of the push element, the rub portion being capable of thermally discoloring a writing with the thermochromic ink by frictional heat generated when the writing with the thermochromic ink is rubbed with the rub portion, wherein when a rubbing operation is performed with the rub portion brought into contact with a sheet of paper, the push element tilts and moves in a radial direction of the push element, so that an outer face of the push element comes into contact with an inner face of the barrel disposed opposite the outer face of the push element, and at least one of the outer face of the push element and the inner face of the barrel disposed opposite the outer face of the push element has irregularities that prevent frontward movement of the push element relative to the barrel.

According to the present aspect, the irregularities on at least one of the outer face of the push element and the inner face of the barrel disposed opposite the outer face of the push element remarkably increase a friction coefficient between the outer face of the push element and the inner face of the barrel by a spike effect and a hysteresis loss to be described later. This configuration thus prevents the frontward movement of the push element relative to the barrel.

The first aspect thus provides a thermochromic writing tool capable of a stable rubbing operation with a simple structure, using a rub portion on a rear end of a push element.

A second aspect of the present invention provides the thermochromic writing tool according to the first aspect, wherein when one of the outer face of the push element and the inner face of the barrel disposed opposite the outer face of the push element has the irregularities, the face having the irregularities is higher in hardness than the face having no irregularities.

According to the present aspect, since the face having the irregularities is higher in hardness than the face having no irregularities, the irregularities on one of the faces more effectively bite into the other face. This configuration therefore more effectively produces the spike effect and the hysteresis loss, and effectively increases the friction coefficient between the outer face of the push element and the inner face of the barrel.

A third aspect of the present invention provides the thermochromic writing tool according to the first or second aspect, wherein the face having the irregularities has a calculated average roughness Ra of 3.2 to 25 as a surface roughness.

According to the present aspect, the face having the irregularities has a calculated average roughness Ra of 3.2 to 25 as a surface roughness. This configuration therefore more effectively produces the spike effect and the hysteresis loss, and effectively increases the friction coefficient between the outer face of the push element and the inner face of the barrel.

Advantageous Effect of Invention

The present invention provides a thermochromic writing tool capable of a stable rubbing operation, using a rub portion on a rear end of a push element.

DESCRIPTION OF EMBODIMENTS

Next, specific embodiments of the present invention will be described in detail with reference to the drawings. In this description, "front" refers to a writing point portion side, and "rear" refers to the opposite side to the writing point portion side. In the respective drawings, corresponding members having the identical function are denoted with the same reference signs.

(Description of a Thermochromic Writing Tool According to an Embodiment of the Present Invention)

Figure 1:
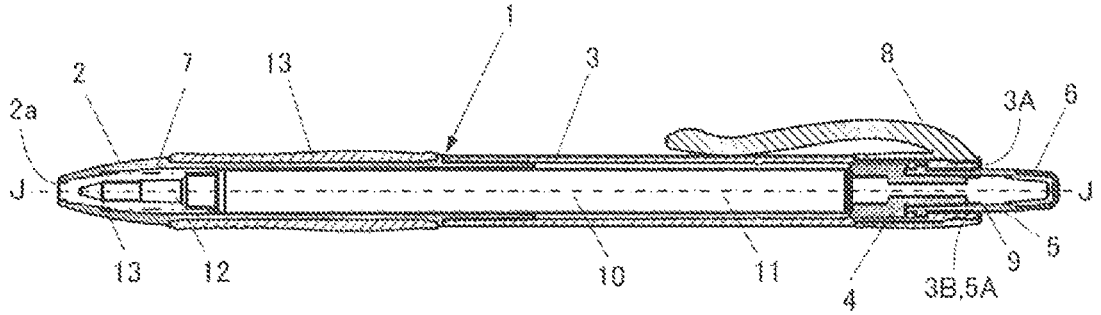
FIG. 1 is a longitudinal sectional view illustrating a thermochromic writing tool according to an embodiment of the present invention.
Figure 2:
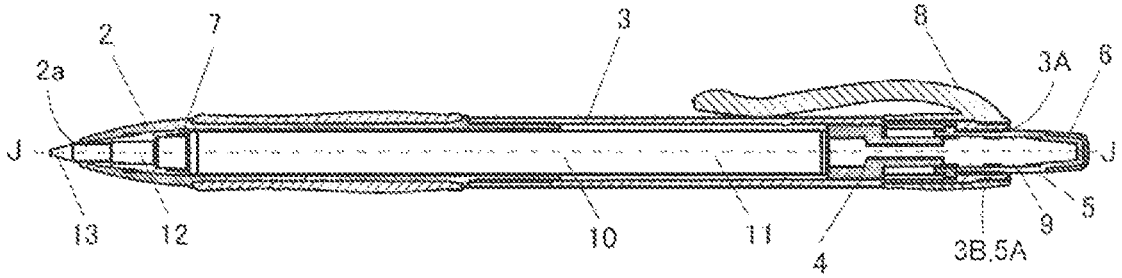
FIG. 2 is a longitudinal sectional view illustrating a state in which a writing point portion in FIG. 1 protrudes.
Figure 3:
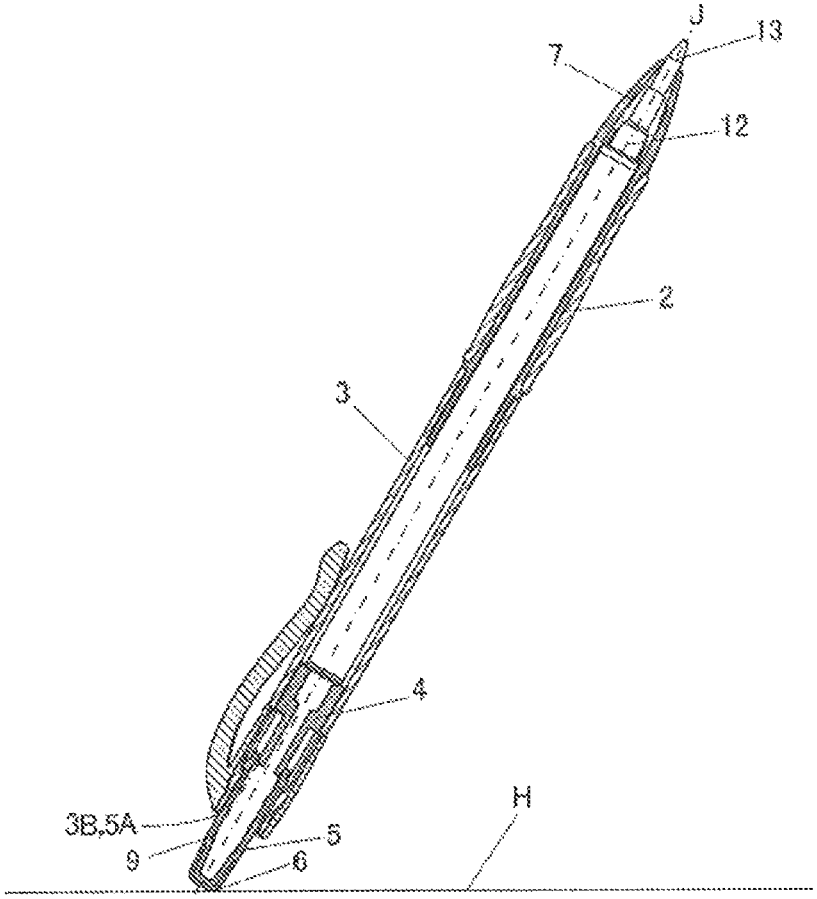
FIG. 3 is a view illustrating an exemplary state in which a rub portion in FIG. 1 is used.
Figure 4:
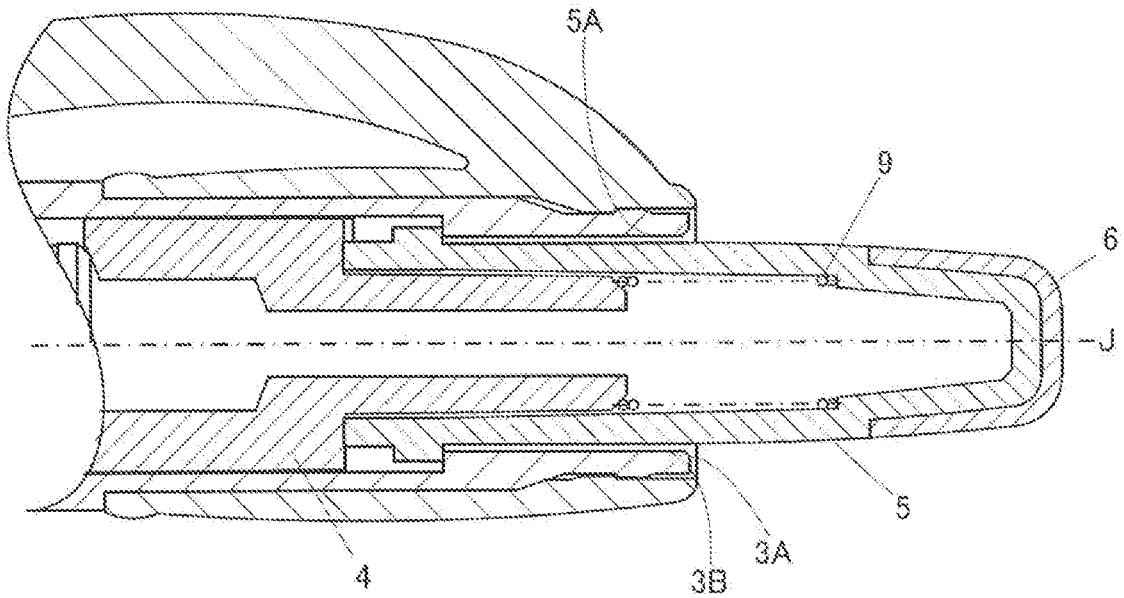
FIG. 4 is an enlarged sectional view of a main part (partially omitted) in FIG. 1.
Figure 5:
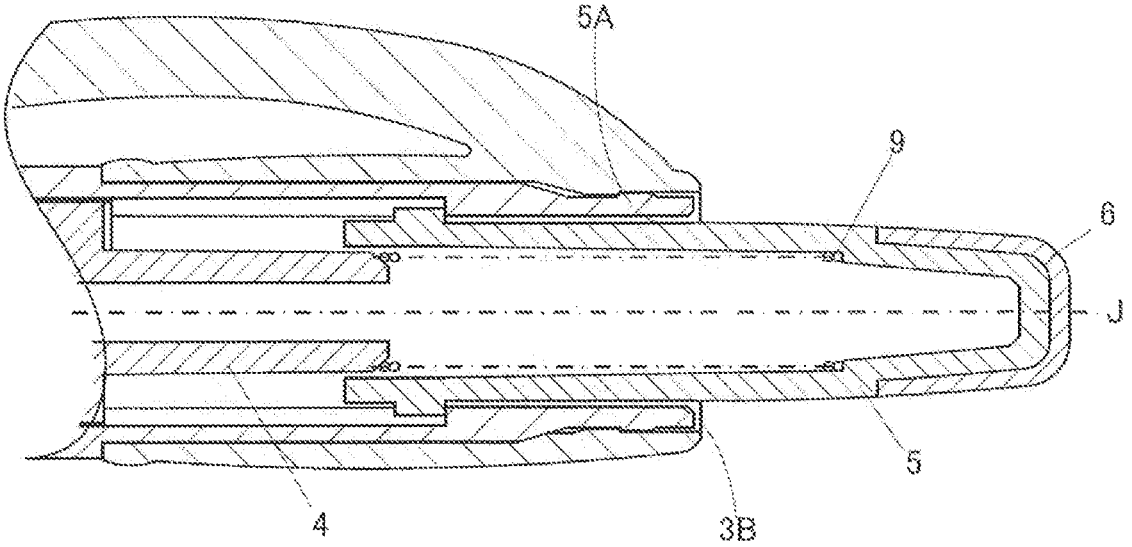
FIG. 5 is an enlarged sectional view of a main part (partially omitted) in FIG. 2.
Figure 6:
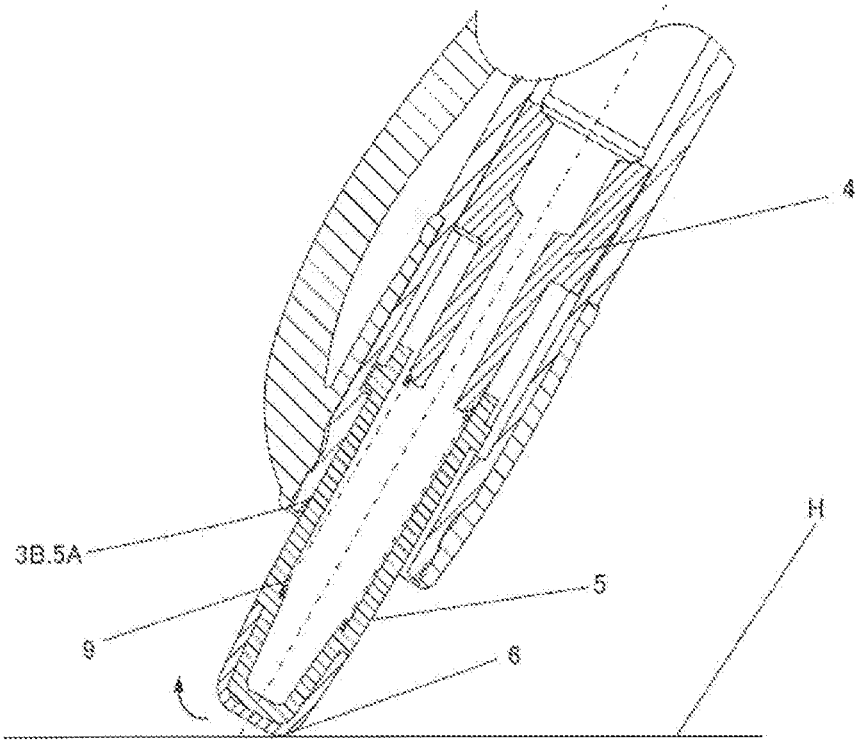
FIG. 6 is an enlarged sectional view of a main part (partially omitted) in FIG. 3.

With reference to FIGS. 1 to 6, there will be described a thermochromic writing tool 1 according to an embodiment of the present invention. FIG. 1 is a longitudinal sectional view illustrating a thermochromic writing tool according to an embodiment of the present invention. FIG. 2 is a longitudinal sectional view illustrating a state in which a writing point portion in FIG. 1 protrudes. FIG. 3 is a view illustrating an exemplary state in which a rub portion in FIG. 1 is used. FIG. 4 is an enlarged sectional view of a main part (partially omitted) in FIG. 1. FIG. 5 is an enlarged sectional view of a main part (partially omitted) in FIG. 2. FIG. 6 is an enlarged sectional view of a main part (partially omitted) in FIG. 3.

In the thermochromic writing tool 1 according to the present embodiment, a writing element y s including a ballpoint refill is biased by a resilient element 7 including a coil spring toward a rear end of a barrel main body, and is slidably accommodated in the barrel main body. The barrel main body includes a barrel (front barrel) 2 and a barrel (rear barrel) 3. In the barrel main body, the barrel (front barrel) 2 is detachably screwed into the barrel (rear barrel) 3. The barrel (rear barrel) 3 is provided with a cap 8 equipped with a clip.

The resilient element 7 has a front end portion that is directly received by an inner wall of the barrel (front barrel) 2, and another end portion (rear end portion) that is directly brought into contact with a tip holder 12 of the writing element 10. The resilient element 7 thus biases the writing element 10 toward the rear end of the barrel main body.

A push element 5 is disposed on a rear end portion of the barrel (rear barrel) 3 so as to protrude rearward from a rear end 3A of the barrel (rear barrel) 3. The push element 5 integrally has, on its front end portion, a plurality of serrated cam portions (not illustrated) that move a rotary cam 4 frontward and induce rotation of the rotary cam 4.

A rub portion 6 is attached to a rear end portion (an edge of an outer peripheral face) of the push element 5. The rub portion 6 is made of an elastic material having rubbery elasticity. Examples of the elastic material may include elastic bodies such as rubber and elastomers having rubbery elasticity. Examples of such an elastic body may include silicone rubber, fluororubber, chloroprene rubber, nitrile rubber, polyester rubber, ethylene propylene diene rubber (EPDM), a styrene elastomer, an ester elastomer, and an olefin elastomer. These elastic bodies may be selected and used as appropriate. Preferably, the rub portion 6 has a Shore A hardness in a range from 40 or more to 100 or less. More preferably, the rub portion 6 has a Shore A hardness in a range from 60 or more to 80 or less. The elastic material to be used for the rub portion is not an elastic material with high wearability (e.g., an eraser), but is an elastic material with low wearability which hardly generates crumbs by friction (eraser crumbs).

The rub portion 6 may be provided integrally with or separately from the push element as long as the rub portion 6 is placed on at least the edge of the outer peripheral face of the rear end of the push element. Specifically, the rub portion may be attached to the push element by fitting, press fitting, screwing, bonding, or fusion welding. Alternatively, the push element and the rub portion may be integrally molded by double molding. Still alternatively, the push element itself may be configured with a soft member. The color of the rub portion is not particularly limited. For example, a colorless and transparent rub portion, a colorless and semitransparent rub portion, or a white rub portion is preferable from the viewpoint of cost reduction by, for example, commonality of parts.

The push element 5 is tiltable in a radial direction relative to an axis J of the barrel, and is biased rearward, that is, toward the rear end 3A of the barrel (rear barrel) 3 by a resilient member 9 in a state in which a writing point portion 13 of the writing element 10 protrudes and in a state in which the writing point portion 13 of the writing element 10 retracts.

A protruding and retracting mechanism is a conventionally known protruding and retracting mechanism including a rotary cam. The protruding and retracting mechanism includes the rotary cam 4, and the cam portions (not illustrated) on the front end portion of the push element 5. The protruding and retracting mechanism is operated when the push element 5 is pressed toward a front-end opening 2*a* of the barrel (front barrel) 2, to allow the writing point portion 13 including a ballpoint tip to protrude from and retract into the barrel (front barrel) 2 through the front-end opening 2*a*.

In the state in which the writing point portion 13 of the writing element 10 protrudes from the barrel (front barrel) 2 through the front-end opening 2*a*, the protruding and retracting mechanism including the rotary cam 4 is operated when the push element 5 is pressed again toward the front-end opening 2*a* of the barrel (front barrel) 2 against a biasing force of the resilient element 7, to allow the writing point portion to retract into the barrel (front barrel) 2.

The writing element 10 includes: a ball enfolding chamber; an ink circulation opening formed at the center of the ball enfolding chamber; and ink circulation grooves communicating with the ink circulation opening, extending radially, and not reaching a tip rear opening. The ballpoint tip of the writing point portion 13 is formed as follows. That is, a ball that is 0.5 mm in diameter and is made of tungsten carbide is mounted on a bottom wall of the ball enfolding chamber. The ball is rotatably enfolded so as to partially project from a tip point edge by swaging a tip point portion inward. The writing point portion 13 is attached to a front end portion of a reservoir 11 through the tip holder 12. A tail plug is attached to a rear end portion of the reservoir 11. A spring (not illustrated) is disposed rearward of the ball to always press the ball.

Thermochromic ink is retained in the reservoir 11. Preferably, reversible thermochromic ink is used as the thermochromic ink to be retained in the reservoir 11. The reversible thermochromic ink may be formed solely from or by combination of various types of ink, such as: ink of a heat color fadable type whose color fades from a color-developed state when heated; ink of a color storage and retention type that stores and retains a color-developed state or a color-faded state at a specific temperature range in an enantiotropic manner; and ink of a heat coloring type that develops color from a color-faded state when heated and that returns to a color-faded state from the color-developed state when cooled.

Preferably, a reversible thermochromic microcapsule pigment is employed as a coloring material contained in the reversible thermochromic ink. The reversible thermochromic microcapsule pigment is formed by enclosing, in a microcapsule, a reversible thermochromic composition containing at least three known indispensable components: (a) an electron-releasing color-reactive organic compound; (b) an electron-accepting compound; and (c) a reactive medium that determines a generation temperature of color reaction of both the compounds.

More specifically, thermochromic ink having the following characteristics and a grease-like ink follower are directly retained in the reservoir 11. The grease-like ink follower is retained subsequent to the thermochromic ink. The thermochromic ink contains a reversible thermochromic microcapsule pigment having an average particle diameter (D50) of 0.5 μm on a volume basis by laser diffraction. The thermochromic ink has an ink viscosity of 1020 mPa·s (25° C.) at 1 rpm, an ink viscosity of 84 mPa·s (25° C.) at 100 rpm, and a shear-thinning index of 0.48. The ink viscosity is measured by an EM-type rotational viscometer.

In writing something with the writing element 10, the ball in the writing point portion 13 moves toward the bottom wall by its rotation and writing pressure, so that the ink is discharged through a clearance between the ball and an inner wall of the tip point portion.

In order to thermally discolor a writing on a sheet of paper H, as illustrated in FIG. 3, the rub portion 6 on the edge of the rear end portion of the push element 5 is brought into press contact with a writing with thermochromic ink on a sheet of paper H of, for example, a notebook. The writing with the thermochromic ink is thus thermally discolored by heat generated when the writing is rubbed with the rub portion 6. In this state, when the rub portion 6 is brought into press contact with the writing, the push element 5 tilts in the radial direction. Then, an outer face 5A of the push element 5 comes into contact with an inner face 3B of the barrel (rear barrel) 3 disposed opposite the outer face 5A of the push element 5. This configuration thus suppresses movement of the push element 5 toward the front-end opening 2*a* of the barrel (front barrel) 2.

Description of a mechanism for increasing a frictional force between the outer face of the push element and the inner face of the barrel (rear barrel).

Figure 7:
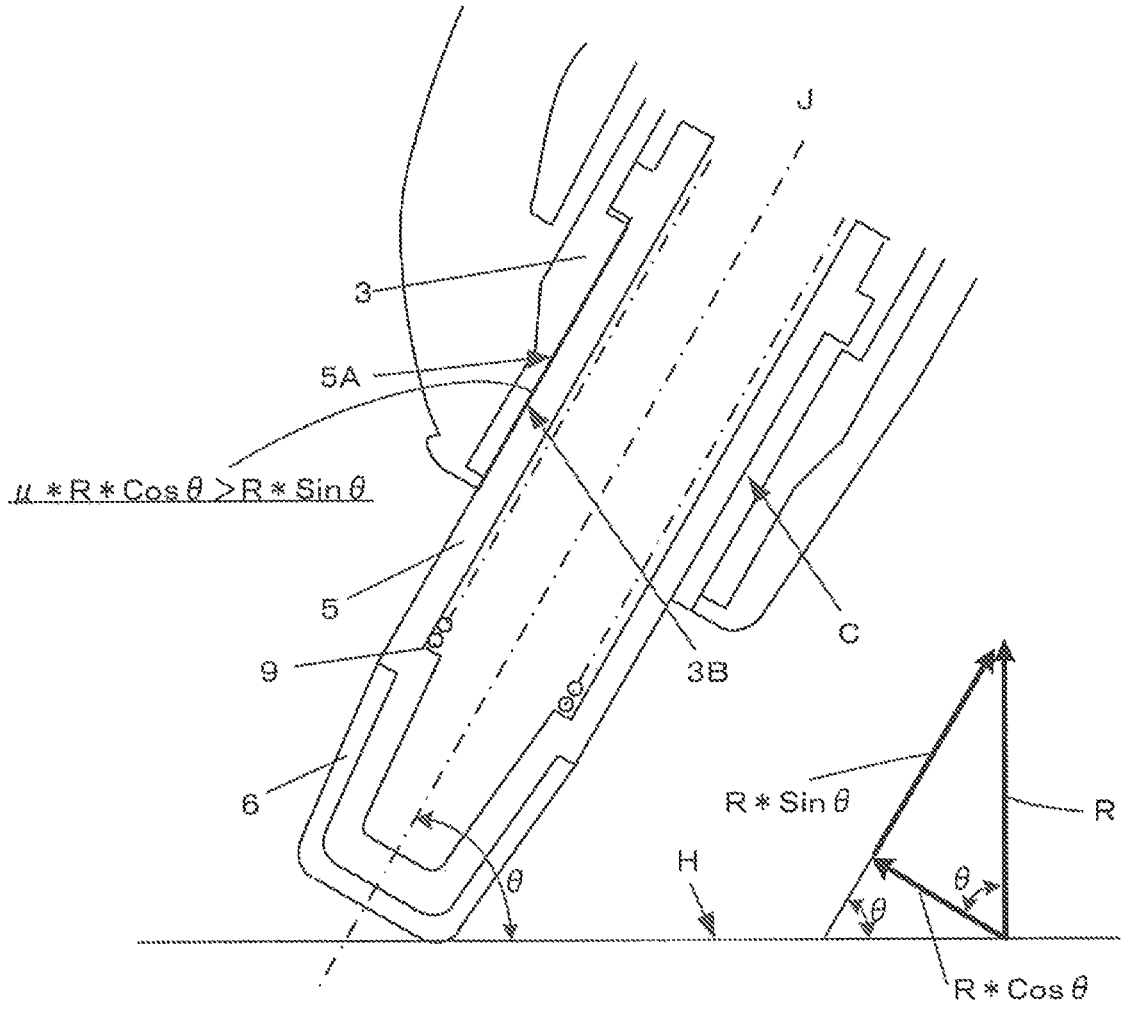
FIG. 7 is a view schematically illustrating a state in which an outer face of a push element and an inner face of a barrel disposed opposite the outer face of the push element are in contact with each other in performing a rubbing operation with a rub portion brought into contact with a sheet of paper.
Figure 8A:
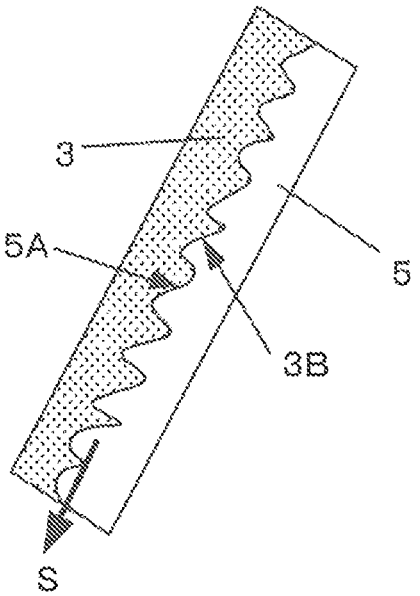
FIGS. 8A to 8C are views each schematically illustrating how to increase a friction coefficient between the outer face of the push element and the inner face of the barrel disposed opposite the outer face of the push element.
Figure 8B:
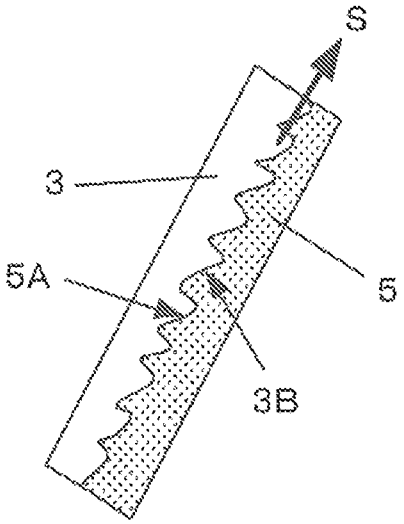

With reference to FIGS. 7, 8A, 8B, and 8C, next, there will be described a mechanism for increasing a frictional force between the outer face 5A of the push element 5 and the inner face 3B of the barrel (rear barrel) 3, and how to suppress the movement of the push element 5 toward the front-end opening 2*a* of the barrel (front barrel) 2. FIG. 7 is a view schematically illustrating a state in which the outer face 5A of the push element 5 and the inner face 3B of the barrel (rear barrel) 3 disposed opposite the outer face 5A of the push element 5 are in contact with each other in performing a rubbing operation with the rub portion brought into contact with the sheet of paper. FIGS. 8A to 8B are views each schematically illustrating how to increase the friction coefficient between the outer face 5A of the push element 5 and the inner face 3B of the barrel (rear barrel) 3 disposed opposite the outer face 5A of the push element 5.

FIG. 7 is a schematic view illustrating the relationship between the frictional force between the outer face 5A of the push element 5 and the inner face 3B of the barrel (rear barrel) 3 and the force to move the push element 5 toward the front-end opening 2*a* of the barrel (front barrel) 2 in the state illustrated in FIG. 6. In FIG. 7, θ represents an angle between the axis J of the thermochromic writing tool 1 and the sheet of paper H, R represents a reaction force received by the thermochromic writing tool 1 from the sheet of paper H, and μ represents the friction coefficient between the outer face 5A of the push element 5 and the inner face 3B of the barrel (rear barrel) 3.

In this case, the force to move the push element 5 toward the front-end opening 2*a* of the barrel (front barrel) 2 is expressed by R*Sin θ, and the frictional force between the outer face 5A of the push element 5 and the inner face 3B of the barrel (rear barrel) 3 is expressed by μ*R*Cos θ.

In order to restrain the movement of the push element 5 toward the front-end opening 2*a* of the barrel (front barrel) 2, it is necessary to make the frictional force between the outer face 5A of the push element 5 and the inner face 3B of the barrel (rear barrel) 3 larger than the force to move the push element 5 toward the front-end opening 2*a* of the barrel (front barrel) 2. It is therefore necessary to establish the following inequality.

$$\mu * R * \cos\theta > R * \sin\theta$$

It is therefore necessary to cause the friction coefficient μ between the outer face 5A of the push element 5 and the inner face 3B of the barrel (rear barrel) 3 to satisfy a relation of μ>Tan θ.

It is said that the angle θ between the axis J of the thermochromic writing tool 1 and the sheet of paper H is typically 70 to 80 degrees. On the other hand, it is said that a friction coefficient of resin by a Coulomb force is typically about 1 at maximum. In this case, an angle θ that satisfies a relation of μ=Tan θ is 45 degrees. If the angle θ between the axis J of the thermochromic writing tool 1 and the sheet of paper H is 70 to 80 degrees, it is impossible to restrain the movement of the push element 5 toward the front-end opening 2*a* of the barrel (front barrel) 2.

In view of this, the inventors of the present invention have found that irregularities formed on at least one of the outer face 5A of the push element 5 and the inner face 3B of the barrel (rear barrel) 3 disposed opposite the outer face 5A of the push element 5 remarkably increase the friction coefficient μ between the outer face 5A of the push element 5 and the inner face 3B of the barrel (rear barrel) 3.

Figure 8C:
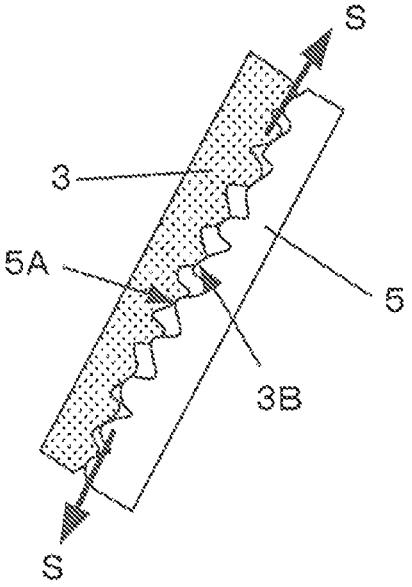

FIG. 8A illustrates a case where irregularities are formed on the outer face 5A of the push element 5. FIG. 8B illustrates a case where irregularities are formed on the inner face 3B of the barrel (rear barrel) 3. FIG. 8C illustrates a case where irregularities are formed on each of the outer face 5A of the push element 5 and the inner face 3B of the barrel (rear barrel) 3.

Preferably, at least one of a region that constitutes the outer face 5A of the push element 5 and a region that constitutes the inner face 3B of the barrel (rear barrel) 3 is made of an elastic material having rubbery elasticity. Examples of the elastic material may include elastic bodies such as rubber and elastomers having rubbery elasticity. Examples of such an elastic body may include silicone rubber, fluororubber, chloroprene rubber, nitrile rubber, polyester rubber, ethylene propylene diene rubber (EPDM), a styrene elastomer, an ester elastomer, and an olefin elastomer. These elastic bodies may be selected and used as appropriate. As to a surface hardness, preferably, at least one of the regions has a Shore A hardness in a range from 40 or more to 100 or less. More preferably, at least one of the regions has a Shore A hardness in a range from 60 or more to 80 or less.

It is apparent from FIGS. 8A to 8C that a contact pressure between the outer face 5A of the push element 5 and the inner face 3B of the barrel (rear barrel) 3 disposed opposite the outer face 5A of the push element 5 causes the irregularities on one of the faces to bite into the other face, which therefore produces a so-called spike effect.

More specifically, the projecting portions on the face are elastically deformed by a shearing force indicated by an arrow S. At this time, the deformed projecting portions attempt to be restored. A restoring force generated at this time increases the frictional force between the outer face 5A of the push element 5 and the inner face 3B of the barrel (rear barrel) 3. This phenomenon is typically referred to as a hysteresis loss. It is said that, for example, a large frictional force on an automotive tire is due largely to this hysteresis loss.

For the purpose of causing the irregularities on one of the faces to more effectively bite into the other face, in the case where the irregularities are formed on one of the outer face 5A of the push element 5 and the inner face 3B of the barrel (rear barrel) 3, preferably, the face having the irregularities is higher in hardness than the face having no irregularities. For example, the hardness of the face having the irregularities is set at a Shore A hardness in a range of about 70 to 100, and the hardness of the face having no irregularities is set at a Shore A hardness in a range of about 40 to 60.

It is considered that in the case where the irregularities are formed on each of the faces, even when both the faces are almost equal in hardness to each other, the irregularities on both the faces engage with each other, thereby satisfactorily producing a spike effect and a hysteresis loss.

Referring to technical literatures, it is said that a friction coefficient μ that causes such a hysteresis loss reaches about 3 (see, for example, "Friction and Wear of Polymers Against Metals", Makoto Watanabe, The Japan Institute of Metals and Materials Journal Vol. 19, No. 1 (1980), and Master's Thesis, "Prediction of Friction Coefficient of Tire Rubber by Multiscale Model", Suguru Kumazawa (2012)).

On the assumption that the friction coefficient μ between the outer face 5A of the push element 5 and the inner face 3B of the barrel (rear barrel) 3 is 3, an angle θ that satisfies a relation of μ=Tan θ=3 is 71.6 degrees. In practice, the addition of a frictional resistance in a region other than the contact face between the outer face 5A and the push element 5 and the inner face 3B of the barrel (rear barrel) 3 and a biasing force of each of the resilient element 7 and the resilient member 9 allows satisfactory restraint of the movement of the push element 5 toward the front-end opening 2*a* of the barrel (front barrel) 2 at the angle θ of 70 to 80 degrees.

As described above, according to the present embodiment, the irregularities formed on at least one of the outer face 5A of the push element 5 and the inner face 3B of the barrel (rear barrel) 3 disposed opposite the outer face 5A of the push element 5 remarkably increase the friction coefficient μ between the outer face 5A of the push element 5 and the inner face 3B of the barrel (rear barrel) 3 by the spike effect and the hysteresis loss. This configuration therefore prevents frontward movement of the push element 5 relative to the barrels 2 and 3. The thermochromic writing tool 1 is thus capable of a stable rubbing operation with a simple structure, using the rub portion 6 on the rear end of the push element 5.

In addition, when the face having the irregularities is higher in hardness than the face having no irregularities, the irregularities on one of the faces more effectively bite into the other face. This configuration therefore more effectively produces the spike effect and the hysteresis loss, and effectively increases the friction coefficient μ between the outer face 5A of the push element 5 and the inner face 3B of the barrel (rear barrel) 3.

Preferably, the outer face 5A, which has the irregularities, of the push element 5 or the inner face 3B, which has the irregularities, of the barrel (rear barrel) 3 has a calculated average roughness Ra of 3.2 to 25 as a surface roughness. This configuration therefore more effectively produces the spike effect and the hysteresis loss, and effectively increases the friction coefficient between the outer face of the push element and the inner face of the barrel. The calculated average roughness Ra was measured based on JIS B0601-2001, using a surface roughness measurement machine (FORM TALYSURF intra manufactured by TAYLOR HOBSON).

Description of a Modification

Figure 9:
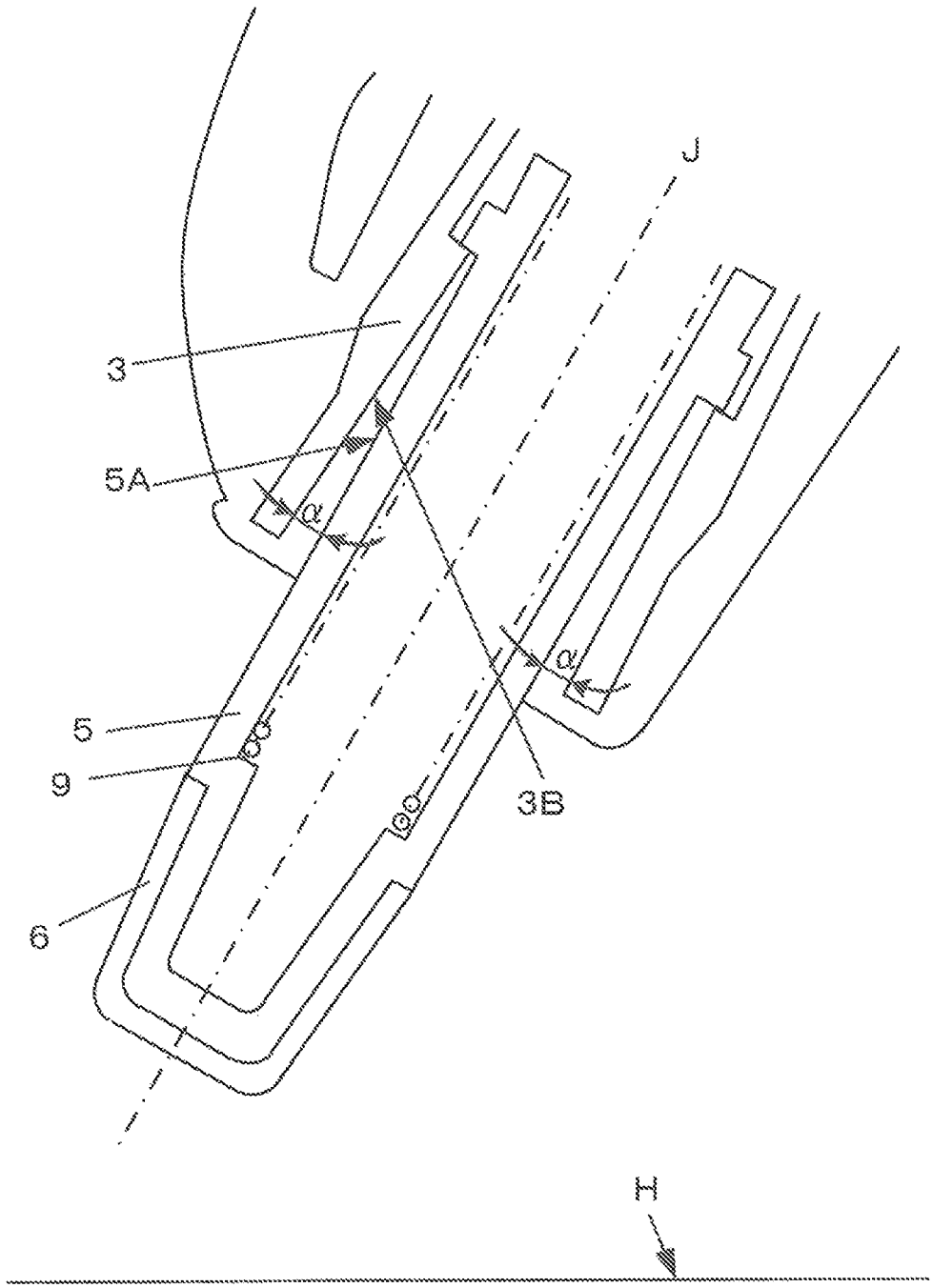
FIG. 9 is a view schematically illustrating a modification of a mechanism for increasing a frictional force between the outer face of the push element and the inner face of the barrel.

With reference to FIG. 9, next, there will be described a modification of the mechanism for increasing the frictional force between the outer face 5A of the push element 5 and the inner face 3B of the barrel (rear barrel) 3. FIG. 9 is a view schematically illustrating the modification of the mechanism for increasing the frictional force between the outer face of the push element and the inner face of the barrel.

In the present modification, the inner face 3B of the barrel (rear barrel) 3 is formed in a tapered shape and is widened toward the writing rear end portion so as to form an angle α relative to the outer face 5A of the push element 5. The angle α may be, for example, 3 to 10 degrees. This configuration therefore enables satisfactory restraint of movement of the push element 5 toward the front-end opening 2*a* of the barrel (front barrel) 2 at the angle θ of 70 to 80 degrees even when the friction coefficient μ is smaller than 3.

(Description of Other Embodiments)

In the present embodiment, the front barrel and the rear barrel constitute the barrel; however, the parts count of the barrel is not particularly limited thereto. For example, the barrel may be constituted of three parts of a front barrel, a middle barrel, and a rear barrel, or may also be constituted of four members of a base, a front barrel, a rear barrel, and a cap. The shapes of the restricting portion and restricted portion are not particularly limited, and may be a projecting shape and/or a recessed shape. Examples of each of the restricting portion and the restricted portion may include, but not limited to, a protruding portion, a groove portion, and a step portion. In addition, the shape of the restricted portion is not particularly limited as long as the movement of the restricted portion is restricted by the contact with the restricting portion. Examples of the restricted portion may include, but not limited to, a step portion, a protruding portion, a recessed portion, and an opening end of a rear barrel.

In the present embodiment, the protruding and retracting mechanism includes the rotary cam. However, the protruding and retracting mechanism is not particularly limited as long as it allows the protrusion and retraction of the writing point portion by a press of the push element. The resilient element that biases the writing element toward the rear end of the barrel is not limited to a coil spring. However, the biasing force of the resilient element has a significant influence on the operability of the push element. Preferably, the biasing force of the resilient element is therefore set at 500 gf to 800 gf in view of the pushing operability and rubbing operability. The biasing force of the resilient element may be measured using a push pull scale.

INDUSTRIAL APPLICABILITY

A thermochromic writing tool according to the present invention is widely applicable as retractable thermochromic writing tools such as a retractable ballpoint pen and a retractable marker pen.

REFERENCE SIGNS LIST

1 thermochromic writing tool
2 barrel (front barrel)
2*a* front-end opening
3 barrel (rear barrel)
3A rear end
3B inner face
4 rotary cam
5 push element
5A outer face
6 rub portion
7 resilient element
8 cap
9 resilient member
10 writing element
11 reservoir
12 tip holder
13 writing point portion

The invention claimed is:

1. A thermochromic writing tool comprising:
a writing element including
a reservoir in which thermochromic ink is retained, and
a writing point portion which is disposed on a front end portion of the reservoir and from which the thermochromic ink is dischargeable;
a barrel which is made of a resin and in which the writing element is accommodated so as to be movable in a longitudinal direction;
a protruding and retracting mechanism including a push element made of a resin and disposed on a rear end portion of the barrel so as to be tiltable in a radial direction relative to an axis of the barrel, the push element having a contour smaller than an inner diameter of the barrel,
the protruding and retracting mechanism being configured to cause the writing point portion to protrude from the barrel through a front-end opening of the barrel when the push element is pressed toward the front-end opening of the barrel,
the protruding and retracting mechanism being configured to cancel a state in which the writing point portion protrudes when the push element is pressed frontward again, and to cause the writing point portion to retract into the barrel through the front-end opening of the barrel; and
a rub portion disposed on a rear end portion of the push element,
the rub portion being capable of thermally discoloring a writing with the thermochromic ink by frictional heat generated when the writing with the thermochromic ink is rubbed with the rub portion,
wherein
when a rubbing operation is performed with the rub portion brought into contact with a sheet of paper, the push element tilts and moves in a radial direction of the push element, so that an outer face of the push element comes into contact with an inner face of the barrel disposed opposite the outer face of the push element,
at least one of the outer face of the push element and the inner face of the barrel disposed opposite the outer face of the push element has irregularities that prevent frontward movement of the push element relative to the barrel, and
when one of the outer face of the push element and the inner face of the barrel disposed opposite the outer face of the push element has irregularities, the face having the irregularities is higher in hardness than the face having no irregularities.

2. The thermochromic writing tool according to claim 1, wherein
the face having the irregularities has a calculated average roughness Ra of 3.2 to 25 as a surface roughness.

3. A thermochromic writing tool comprising:
a writing element including
a reservoir in which thermochromic ink is retained, and
a writing point portion which is disposed on a front end portion of the reservoir and from which the thermochromic ink is dischargeable;
a barrel which is made of a resin and in which the writing element is accommodated so as to be movable in a longitudinal direction;
a protruding and retracting mechanism including a push element made of a resin and disposed on a rear end portion of the barrel so as to be tiltable in a radial direction relative to an axis of the barrel, the push element having a contour smaller than an inner diameter of the barrel,
the protruding and retracting mechanism being configured to cause the writing point portion to protrude from the barrel through a front-end opening of the barrel when the push element is pressed toward the front-end opening of the barrel, the protruding and retracting mechanism being configured to cancel a state in which the writing point portion protrudes when the push element is pressed frontward again, and to cause the writing point portion to retract into the barrel through the front-end opening of the barrel; and a rub portion disposed on a rear end portion of the push element, the rub portion being capable of thermally discoloring a writing with the thermochromic ink by frictional heat generated when the writing with the thermochromic ink is rubbed with the rub portion, wherein when a rubbing operation is performed with the rub portion brought into contact with a sheet of paper, the push element tilts and moves in a radial direction of the push element, so that an outer face of the push element comes into contact with an inner face of the barrel disposed opposite the outer face of the push element, at least one of the outer face of the push element and the inner face of the barrel disposed opposite the outer face of the push element has irregularities that prevent frontward movement of the push element relative to the barrel, and the face having the irregularities has a calculated average roughness Ra of 3.2 to 25 as a surface roughness.

* * * * *